United States Patent [19]

Durbin, III

[11] 4,454,744

[45] Jun. 19, 1984

[54] METHOD OF FORGING A BIFURCATED MEMBER

[75] Inventor: Votaw S. Durbin, III, St. Louis, Mo.

[73] Assignee: Durbin-Durco, Inc., St. Louis, Mo.

[21] Appl. No.: 281,960

[22] Filed: Jul. 10, 1981

[51] Int. Cl.[3] ..... B21J 3/02; B21K 13/00

[52] U.S. Cl. ..... 72/362; 72/338; 72/341; 29/34 R

[58] Field of Search ..... 72/338, 340, 341, 377, 72/356, 362, 414, 372–376; 29/33 A, 34 R, 175 R, 175 A, 457, 155 R, 458, 178; 76/101, 103

[56] References Cited

U.S. PATENT DOCUMENTS

| | | | |
|---|---|---|---|
| 106,225 | 8/1870 | Smith | 29/175 R |
| 732,876 | 7/1903 | Meyer | 72/377 |
| 1,080,278 | 12/1913 | Hobbs | 72/377 |
| 1,595,333 | 8/1926 | Anderson | 72/377 |
| 1,625,804 | 4/1927 | Hansson | 72/373 |
| 1,753,216 | 4/1930 | Peirce, Jr. | 254/390 |
| 1,925,721 | 9/1933 | Johnston | 29/175 A |
| 1,958,178 | 5/1934 | Anderson | 72/377 |
| 2,239,203 | 4/1941 | Rendleman | 72/338 |
| 3,160,479 | 12/1964 | Davenport | 72/377 |
| 3,889,512 | 6/1975 | Delio | 72/377 |
| 4,041,754 | 8/1977 | Otani | 72/377 |
| 4,094,183 | 6/1978 | Mettler | 72/377 |

*Primary Examiner*—Lowell A. Larson
*Attorney, Agent, or Firm*—Cohn, Powell & Hind

[57] ABSTRACT

A method of forging a bifurcated member having closely spaced parallel portions including the steps of forging the member to form diverging bifurcated portions, and coining the diverging bifurcated portions inwardly toward each other into substantially parallel relation having a narrow slot therebetween.

2 Claims, 11 Drawing Figures

METHOD OF FORGING A BIFURCATED MEMBER

BACKGROUND OF THE INVENTION

This invention relates generally to a method of forging a member, and particularly to a method of forging a member having closely spaced bifurcated portions.

Handles for load binders represent an elongate member having a bifurcated end. The bifurcated end includes two portions which are relatively thick and closely spaced. Because of the close spacing of the bifurcated portions and their thickness, conventional forging methods cannot be readily utilized for directly making the member.

In the heretofore conventional method of making a bifurcated member, the member is forged to provide an enlarged head at one end. Then, a narrow slot is cut or milled in the head to provide the bifurcated portions. This cutting or milling operation is relatively expensive and more time consuming than if the member could be completely formed by a forging operation.

SUMMARY OF THE INVENTION

The present method of forging a bifurcated member enables the forming of a member having closely spaced and relatively thick bifurcated portions completely by forging steps, and avoids the need for milling or cutting operations.

The present method of forging a member having closely spaced parallel bifurcated portions comprises the steps of first forging a member to form diverging bifurcated portions, and then coining the diverging bifurcated portions inwardly toward each each other into substantially parallel relation having a narrow slot therebetween.

In one aspect of the invention, the member is forged to form an interconnecting web between the diverging bifurcated portions. The member is then forged to punch out the interconnecting web from between the diverging bifurcated portions before coining.

In another aspect of the invention, excess external material from the formed member is trimmed before coining. In yet another aspect of the invention, a billet is placed into a forging die and struck with a forging hammer to form an elongate member having diverging bifurcated portions with an interconnecting web therebetween. This formed member is placed into another forging die and struck with a forging hammer to trim excess external material from the formed member. The trimmed member is placed in another forging die and struck with a forging hammer to punch out the interconnecting web from between the diverging bifurcated portions. The punched member is placed in another forging die, and the bifurcated portions are coined inwardly toward each other and into substantially parallel relation having a narrow slot therebetween.

In another aspect of the invention, the forged bifurcated portions diverge laterally outward to one end to provide a diverging slot therebetween having a relatively wide entrance at the one end and a relatively narrow throat inwardly of the one end. A web is forged transversely of the diverging slot, and interconnects the bifurcated portions. After the transverse web is then punched out, the bifurcated portions are coined toward each other into substantially parallel relation having a slot of substantially constant width therebetween. In another aspect, the diverging bifurcated portions are disposed in substantially vertical relation, while the web extends transversely of the slot in substantially horizontal relation.

DESCRIPTION OF THE PREFERRED EMBODIMENT

Figure 2:
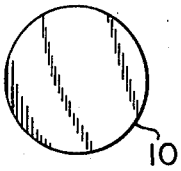
FIG. 2 is an end view of the billet of FIG. 1.
Figure 1:
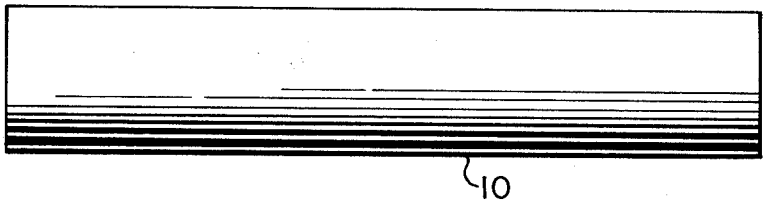
FIG. 1 is a side elevational view of a billet.
Figure 3:
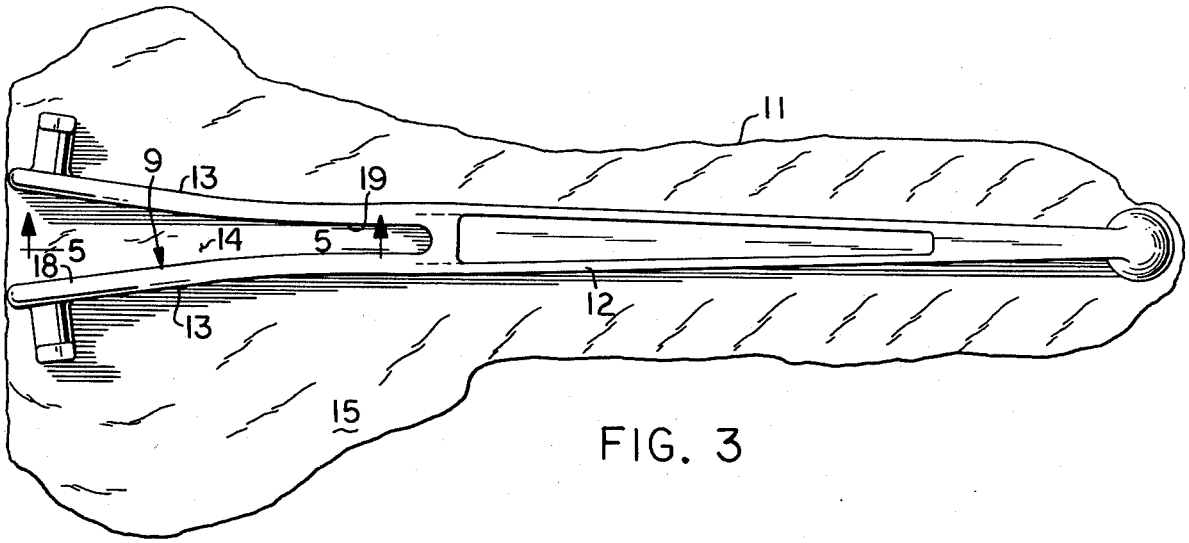
FIG. 3 is a top plan view of the member after forging to form bifurcated portions with diverging slot and web therebetween.

Referring now by characters of reference to the drawings, the method of forging a bifurcated or clevis member will be described A metallic billet such as the cylindrical billet 10 shown in FIGS. 1 and 2 is utilized. The billet 10 utilized for forming the particular member disclosed in the drawings, such as a lever handle in a load binder, is $1\frac{7}{8}$ inches in diameter by 10 inches long, and consists of 1043 carbon steel. The particular size and composition of the billet 10 is dependent upon the size and application of the member to be formed.

Figure 4:
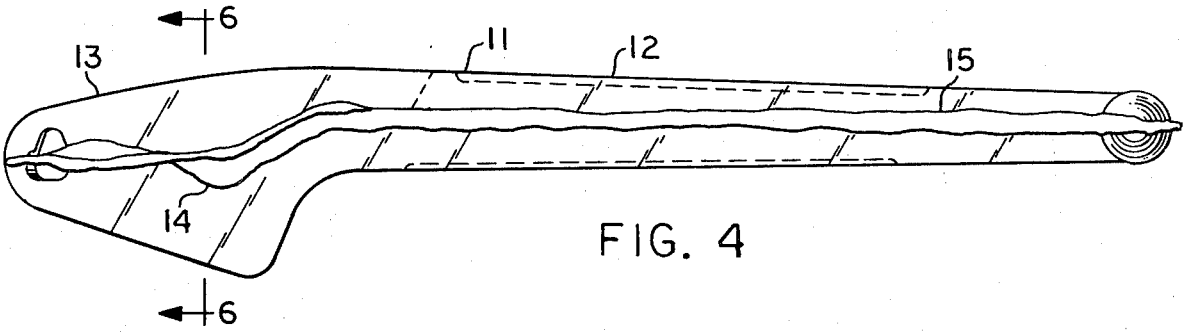
FIG. 4 is a side elevational view of the member of FIG. 3.
Figure 5:
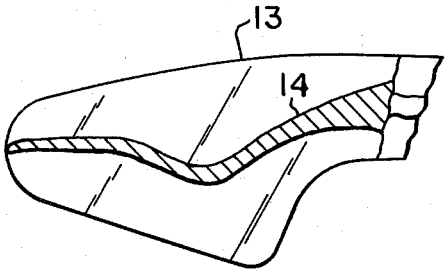
FIG. 5 is a cross-sectional view taken on line 5—5 of FIG. 3.
Figure 6:
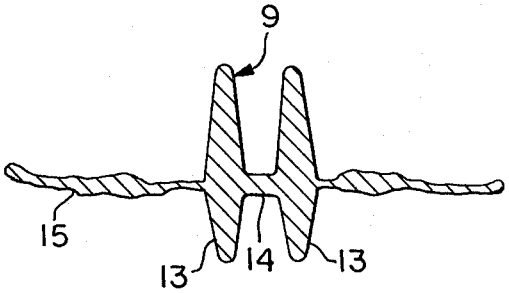
FIG. 6 is a cross-section taken on line 6—6 of FIG. 4.

The billet 10 is placed in a forging die (not shown) and is struck by a forging hammer (not shown) to form the member 11 which includes a handle portion 12 having diverging bifurcated portions 13 with a web 14 therebetween. Excess material 15 is located about the handle 12. As can be seen in FIGS. 4, 5 and 6, the bifurcated portions 13 have a substantial relative thickness and are disposed insubstantially vertical relation. The bifurcated portions 13 diverge laterally outward to one end to provide a diverging slot 9 therebetween. The slot 9 has a relatively wide entrance 18 at the one end and a relatively narrow throat 19 inwardly of the one end. The web 14 extends transversely of the slot 9 between the bifurcated portions 13 in substantially horizontal relation.

Figure 7:
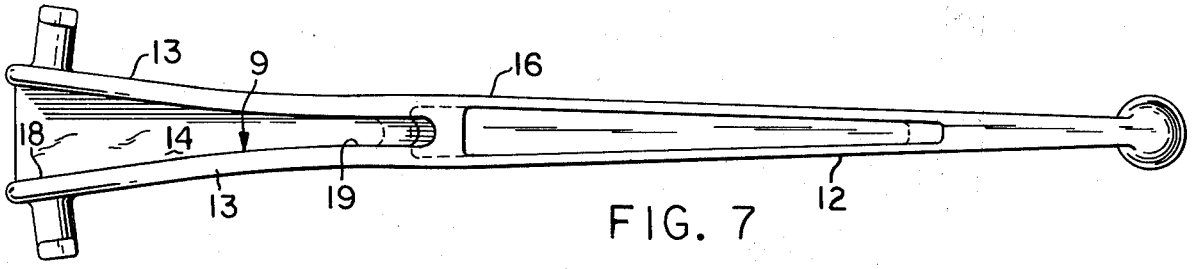
FIG. 7 is a top plan view of the member shown in FIGS. 3 and 4 after trimming.
Figure 8:
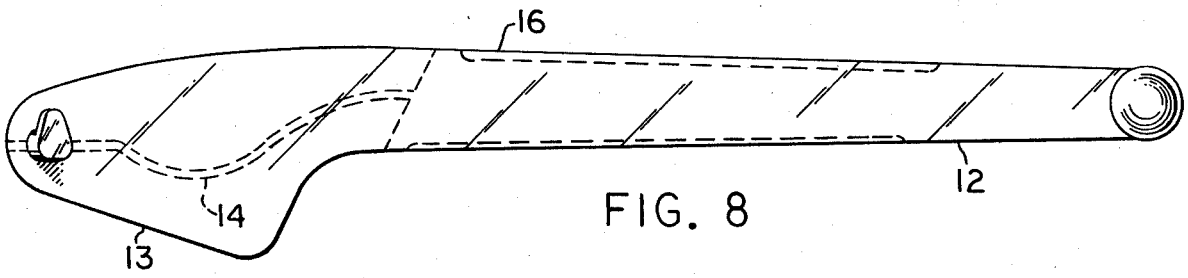
FIG. 8 is a side elevational view of the member of FIG. 7.

The member 11 is placed in another forging die (not shown) and struck with a forging hammer (not shown) to trim the excess external material 15 from the handle 12. This trimming operation results in the production of member 16 of FIGS. 7 and 8. The web 14 extending transversely of slot 9 still interconnects the bifurcated portions 13 of the handle 12.

Figure 9:
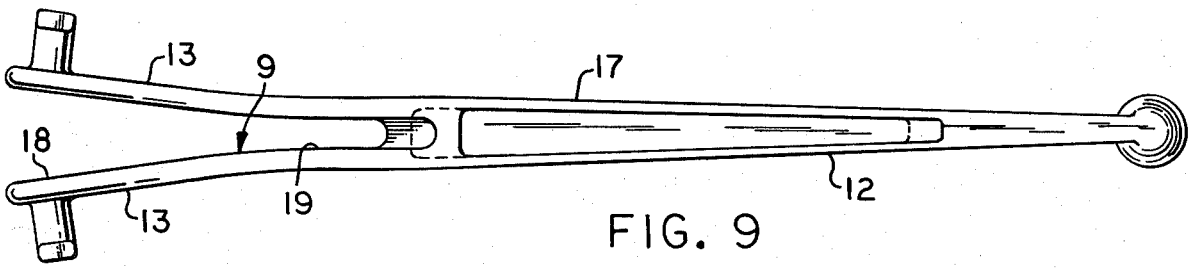
FIG. 9 is a top plan view of the member shown in FIGS. 7 and 8 after punching out the web.

The member 16 is placed in yet another forging die (not shown) and struck with a forging hammer (not shown) to punch the interconnecting web 14 from between the bifurcated portions 13 of the handle 12. The transverse web 14 can be removed in this manner because the diverging slot 9 provides sufficient width to receive the punch portion of the forging die. This punching operation results in the production of the member 17 of FIG. 9.

Figure 10:
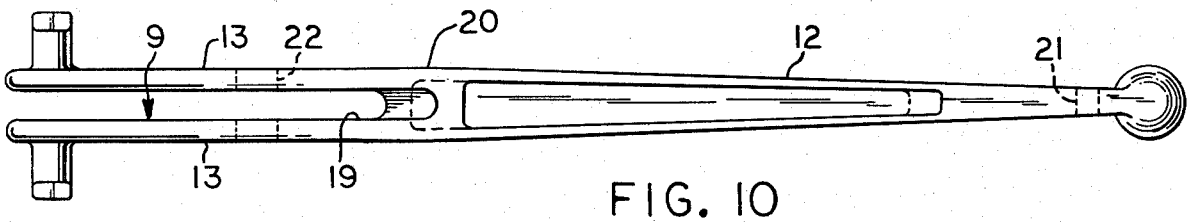
FIG. 10 is a top plan view of the completed member.

Next, the member 17 is placed in a forging die (not shown) and struck with a forging hammer (not shown) in a hot-coining operation. The bifurcated portions 13 are coined inwardly toward each other into closely spaced, substantially parallel relationship as shown in FIG. 10. The slot 9 is now of substantially constant width, such width conforming essentially to the width of the narrow slot throat 19. The member 20 of FIGS. 10 and 11 is the finished handle 12.

The member 20 as shown has been punched to provide the hole 21 at one end of the handle, and the transversely aligned holes 22 in the bifurcated portions 13. The holes 21 and 22 are required for the particular application of this handle 20, which is for use in a load binder.

Figure 11:
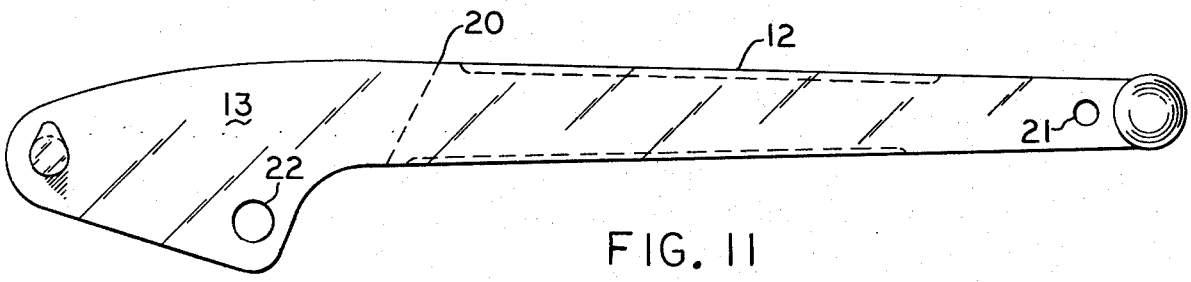
FIG. 11 is a side elevational view of the completed member of FIG. 10.

It is readily apparent from the drawings of FIGS. 10 and 11 that, because the bifurcated portions 13 are relatively thick and the slot therebetween is relatively narrow, the handle 20 could not be forged directly in its final form. The particular handle 20 is just one example of the types of bifurcated or clevis members which can be formed with the present method without the requirement of milling the area between the bifurcated members.

I claim as my invention:

1. A method of forging a member having closely spaced, substantially parallel bifurcated portions, comprising the steps of:

(a) forging the member to form a handle with a pair of relatively thick bifurcated portions at one end having a relatively thin transverse web therebetween, the bifurcated portions and the web diverging laterally outward to a relatively wide entrance from a relatively narrow throat, (b) forging the member to punch out the transverse interconnecting web from between the bifurcated portions, and (c) coining the bifurcated portions inwardly toward each other into substantially parallel relation having a slot of substantially constant width therebetween.

2. A method of forging a member as defined in claim 1, including the steps of:

(d) forging the relatively thick diverging bifurcated portions into substantially vertical relation and forging the handle into a non-uniform shape, and (e) forging the diverging web to extend transversely of the slot between the bifurcated portions in substantially horizontal relation.

* * * * *